US007347417B2

(12) United States Patent
Kutzer

(10) Patent No.: US 7,347,417 B2
(45) Date of Patent: Mar. 25, 2008

(54) METHOD AND ARRANGEMENT FOR DETECTING OVERLAPPING FLAT MAILPIECES

(75) Inventor: Oliver Kutzer, Radolfzell (DE)

(73) Assignee: Siemens Aktiengesellschaft, Munich (DE)

( * ) Notice: Subject to any disclaimer, the term of this patent is extended or adjusted under 35 U.S.C. 154(b) by 114 days.

(21) Appl. No.: 10/585,009

(22) PCT Filed: Nov. 27, 2004

(86) PCT No.: PCT/EP2004/013496

§ 371 (c)(1),
(2), (4) Date: Jun. 29, 2006

(87) PCT Pub. No.: WO2005/066052

PCT Pub. Date: Jul. 21, 2005

(65) Prior Publication Data

US 2007/0164507 A1 Jul. 19, 2007

(30) Foreign Application Priority Data

Dec. 30, 2003 (DE) ..... 103 61 720

(51) Int. Cl.
*B65H 7/12* (2006.01)

(52) U.S. Cl. ..... 271/262; 271/263; 271/265.04

(58) Field of Classification Search ..... 271/262, 271/263, 265.04

See application file for complete search history.

(56) References Cited

U.S. PATENT DOCUMENTS

| | | | | |
|---|---|---|---|---|
| 3,186,708 | A | 6/1965 | Hinz | |
| 4,733,226 | A | 3/1988 | Kasuya et al. | |
| 5,505,440 | A | 4/1996 | Uematsu | |
| 5,560,598 | A | 10/1996 | Goldkuhle | |
| 7,234,695 | B2 * | 6/2007 | Tsukamoto et al. | 271/122 |
| 7,267,339 | B2 * | 9/2007 | Mitsuya et al. | 271/262 |
| 2003/0234158 | A1 | 12/2003 | Zattler | |
| 2004/0195760 | A1 | 10/2004 | Zimmermann et al. | |
| 2006/0082048 | A1 * | 4/2006 | Mitsuya et al. | 271/262 |

FOREIGN PATENT DOCUMENTS

| | | |
|---|---|---|
| DE | 196 25 044 A1 | 1/1998 |
| JP | 01172151 | 7/1989 |
| JP | 09020438 | 1/1997 |
| JP | 11334938 | 12/1999 |
| WO | WO01/89724 | 11/2001 |

OTHER PUBLICATIONS

Derwent Abstract—DE-196 25 044 A1; Jan. 2, 1998; Siemens Aktiengesellschaft, D-80333 München, Germany.

* cited by examiner

*Primary Examiner*—David H Bollinger

(57) ABSTRACT

To detect overlapping flat mailpieces in a transport path that are transported vertically in succession at least two transport stages are successively arranged. Each transport stage has a nominal speed, wherein the nominal speed of a following transport stage in a transport direction is higher than the nominal speed of the preceding transport stage. A speed of the transported mailpieces is measured by scanning the items in front of a following transport stage for a maximum distance that is shorter than a shortest agreed mailpiece length by means of two sensors. Measured results are evaluated if a sensor measures a speed that deviates only slightly by a defined small value from the nominal speed of the following transport stage. An overlap is detected if simultaneously measured speeds of the two sensors are different and a smaller measured speed deviates from a greater speed by a defined value.

5 Claims, 1 Drawing Sheet

METHOD AND ARRANGEMENT FOR DETECTING OVERLAPPING FLAT MAILPIECES

BACKGROUND OF THE INVENTION

The invention relates to a method and an arrangement for detecting overlapping flat mailpieces in a transport path for mailpieces that are transported vertically in succession.

A problem that arises in connection with separating devices consists in what are referred to as double-feed errors which occur as a result of the fact that in addition to the mailpiece that is to be removed from a stack a further mailpiece is picked off simultaneously. In sorting systems for flat mailpieces the undetected double feeds are particularly significant because they increase the missorting rate due to read errors by the automatic address identification system, but can also lead to a mailpiece jam with destruction of mailpieces as a consequence.

In a known solution movable mailpiece sections are temporarily deflected perpendicularly with respect to the conveyance direction. The presence of overlapping mailpieces is then detected by analyzing the flip-back behavior of the mailpieces (EP 0 650 911 B1). As a different offset of the overlapping mailpieces can be present, the deflection must be effected both on the front side of the mailpiece and on the rear side of the mailpiece, which results in increased complexity and expense. Also disadvantageous is the mechanical stress to which the mailpieces are subjected during the deflection. A further deficiency of this solution consists in the fact that the offset of the trailing edges must not fall below a minimum value (approx. 10 mm).

In another known solution the profile of the mailpiece height is measured and an overlap is reported in the event of a change in height (DE 196 25 044 A1).

There are possibilities of overlaps of two mailpieces occurring which cannot be detected by the above-cited solutions. This is the case in particular with identical, congruent mailpieces. However, it is also possible that a large mailpiece covers a small mailpiece in such a way that a double feed is transported onward undetected.

DE 12 10 601 A discloses a method and an arrangement for detecting mailpiece overlaps, wherein edges on both sides of the transport path are determined using edge detection measuring means. Congruent mailpieces lying on top of one another cannot be detected by this means.

A method and an arrangement for detecting mailpiece overlaps can be derived from U.S. Pat. No. 5,505,440 A, wherein the total length of a mailpiece or overlapping mailpiece is measured, subsequently overlapping mailpieces are displaced with respect to one another and then the total length is measured a second time. With this solution it is not possible to detect mailpiece overlaps if a large and a small mailpiece are overlapped and the small mailpiece is still in the shadow of the large mailpiece before and after the displacement.

A solution was also known (DE 101 42 331 C1) wherein after edges have been detected on both sides of the transport path and after the distances between the detected edges and the leading front edge measured by means of a light barrier in each case have been determined, both sides of the longitudinal sides of the mail are acted upon at different transport speeds, ensuring that the minimum gaps are maintained. The distances between the edges and the leading front edge are then measured a second time. A double feed is detected if there is a change in distance. In this case too, an overlap is determined by means of edge detection.

It is known from WO 01/89 724 A1 and JP 09-020 438 AA to detect overlapping mailpieces within a transport stage by means of a speed sensor arranged on one side of the transport path.

Transport paths are known from DE 102 12 024 A1 wherein the nominal speed of successive transport stages increases in the transporting direction.

SUMMARY OF THE INVENTION

The object underlying the invention is to detect in as early and reliable a manner as possible overlapping narrow mailpieces in a transport path for mailpieces transported sequentially in a vertical position.

The object is achieved by a method and apparatus for detecting overlapping flat mailpieces in a transport path for mailpieces that are transported vertically in succession. At least two transport stages are successively arranged in the transport path. Each transport stage has a nominal speed, wherein the nominal speed of a following transport stage in a transport direction is in each case higher than the nominal speed of the transport stage preceding it. A speed of the transported mailpieces is measured by scanning the items in front of a following transport stage for a maximum distance that is shorter than a shortest agreed mailpiece length by means of two sensors that are arranged on either side of the transport path. Measured results are evaluated if a sensor measures a speed that deviates only slightly by a defined small value from the nominal speed of the following transport stage. An overlap is detected if simultaneously measured speeds of the two sensors are different and a smaller measured speed deviates from a greater speed by a defined value.

In this arrangement at least two transport stages are disposed sequentially in the transport path, with the nominal speed of the next transport stage in the transport direction in each case being higher than the nominal speed of the preceding transport stage.

The speed of the transported mailpieces is then measured by scanning said items in front of a following transport stage for a maximum distance that is shorter than the shortest agreed length for a mailpiece by means of two sensors that are arranged on either side of the transport path and the measured results are evaluated if a sensor measures a speed that deviates only slightly by a defined small value from the nominal speed of the following transport stage.

During the evaluation an overlap is detected if the speeds measured simultaneously by the two sensors are different, with the lower measured speed deviating from the higher measured speed by a defined value. In contrast to the detection of overlapping mailpieces by way of a detection of the front and rear edges with the aid of light barriers, according to the invention the overlapping mailpieces are detected very early and reliably by means of the measurement of the speed of the mailpiece.

Advantageous embodiments of the invention are set forth in the dependent claims.

Thus, it is particularly advantageous to use locally fixed rollers or belts running on the mailpiece surfaces as sensors for measuring the mailpiece speed, the rotational speeds of said rollers or belts serving as a measure for the mailpiece speed. In this way a robust solution entailing little effort and expenditure is achieved.

In order to avoid inaccuracies in the measurements as a result of extensions of the mailpieces during the accelerations, the evaluation of the measurement results does not start until after a specified delay time after the change in speed measured by a sensor to a speed deviating from the nominal speed of the following transport stage only by a specified small value.

BRIEF DESCRIPTION OF THE SEVERAL VIEWS OF THE DRAWINGS

The invention will subsequently be explained in an exemplary embodiment with reference to the drawing, in which.

DETAILED DESCRIPTION OF THE INVENTION

Figure 1:
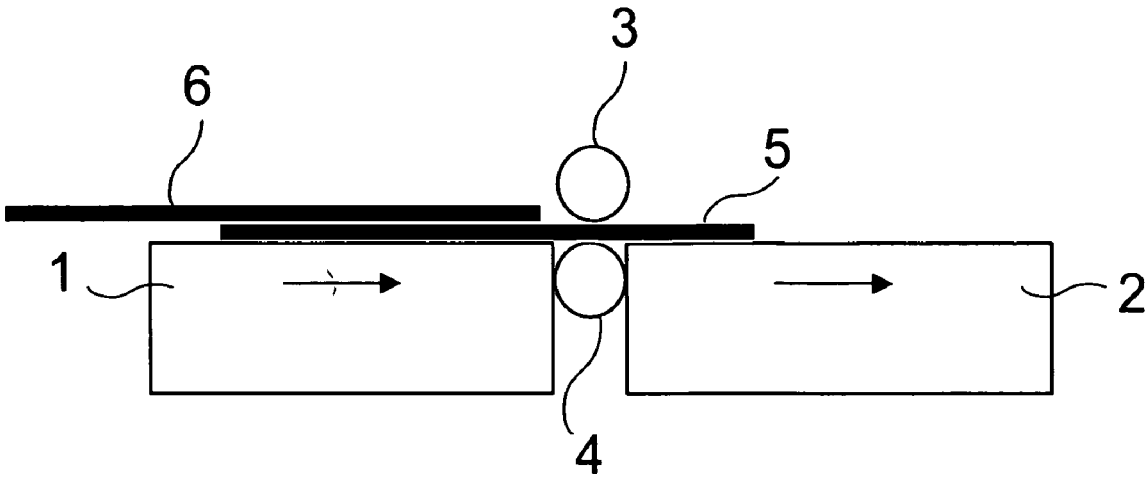
FIG. 1 shows a schematic top view onto two transport stages and two speed sensors arranged therebetween

In the example shown, the transport path is that of a separating device in which the flat mailpieces 5, 6 are separated from a stack in a plurality of transport stages 1, 2. In each subsequent stage an acceleration to a higher speed value takes place. As soon as the mailpiece has been accepted by the following transport stage 2, the speed of the preceding transport stage 1 is reduced. If an overlap (double feed) is present, mailpieces 5, 6 that as a result are somewhat offset with respect to each other are shifted against each other. In this example two transport stages 1, 2 are provided for accelerating, followed by a transport section with a higher nominal speed which has two transfer rollers 7, 8 at its start. At the same time it is necessary to monitor whether and how long overlaps exist.

For this purpose, according to FIG. 1, in which the two transport stages 1, 2 of the separating device are shown, two sensors 3, 4 for measuring the speed of the mailpieces are arranged between the two transport stages 1, 2 on both sides of the transport path. Also to be seen are two partially overlapping mailpieces 5, 6, with the front mailpiece 5 already located within the sphere of action of the upstream transport stage 2. Each sensor 3, 4 is implemented here by means of a roller running on the mailpiece surface and driving a tachogenerator. The tachogenerator's output signal corresponding to the rotational speed is transmitted as a measured signal to an evaluation device.

If a mailpiece enters into the transition between two transport stages 1, 2, the speeds of the sensors 3, 4 are monitored. If the difference between the highest measured speed value and the speed of the following transport stage 2 is less than a defined small limit value, it is assumed that the mailpiece 3 is transported almost free of slip by the transport stage 2. From this time the two sensors 3, 4 are monitored. If the difference between the smallest measured speed and the speed of the following transport stage 2 is greater than a defined limit value, then an overlap is detected which is drawn apart at the transition between the two transport stages 1, 2 owing to the speed differences.

The monitoring remains active until the last rear edge has left the sensors 3, 4.

Figure 2:
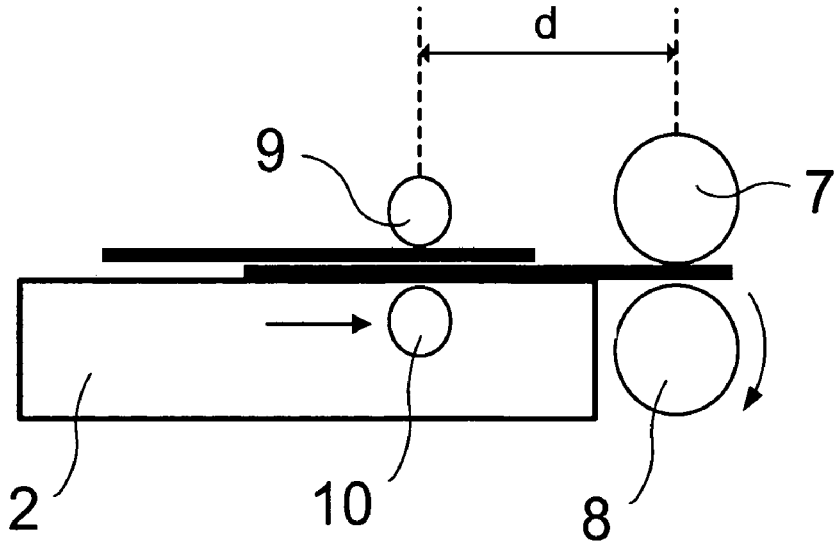
FIG. 2 shows a schematic top view onto two transport stages, with two larger pressure rollers being disposed at the start of the second transport stage

The transition area between the transport stage 2 and the transfer rollers 7, 8 of the following transport section (both form a third transport stage) is shown in FIG. 2. Starting with the transfer rollers 7, 8, the flat mailpieces 5, 6 are gripped in a non-slip manner in the transport section embodied as a sandwich conveyor system and transported onward at a speed that is increased compared with the transport stage 2. As the relatively large transfer rollers 7, 8 are arranged as closely as possible to the transport stage 2 for the reliable transfer of the mailpieces 5, 6, there is insufficient space present to provide the sensors 9, 10 therebetween. For this reason the sensors 9, 10 are located in the area of the transport stage 2 at a distance d less than the shortest mailpieces 5, 6 to be processed from the pinching points of the transfer rollers 7, 8.

If a mailpiece 5 enters the pinching point of the transfer rollers 7, 8, e.g. is detected by mans of a light barrier, the sensors 9, 10 are monitored from this time. If the difference between the smallest measured speed and the transport speed of the transfer rollers 7, 8 is greater than a defined limit value, then an overlap is likewise detected.

The monitoring remains active until the rear edge has left the sensors 9, 10.

In order to compensate for a stretching of the mailpieces 5, 6 that is permitted during the acceleration, the overlap monitoring can be briefly delayed with the aid of a timer.

The invention claimed is:

1. A method for detecting overlapping flat mailpieces in a transport path for mailpieces that are transported vertically in succession, comprising the following steps:

arranging at least two transport stages successively in the transport path, wherein each transport stage has a nominal speed, wherein the nominal speed of a following transport stage in a transport direction is in each case higher than the nominal speed of the transport stage preceding it, measuring a speed of the transported mailpieces by scanning said items in front of a following transport stage for a maximum distance that is shorter than a shortest agreed mailpiece length by means of two sensors that are arranged on either side of the transport path, evaluating measured results if a sensor measures a speed that deviates only slightly by a defined small value from the nominal speed of the following transport stage, and detecting an overlap if simultaneously measured speeds of the two sensors are different and a smaller measured speed deviates from a greater speed by a defined value.

2. The method as claimed in claim 1, wherein the sensors for measuring the speed of the mailpieces are embodied as locally fixed rollers or belts running on mailpiece surfaces, rotational speeds of said rollers or belts serving as a measure for the speed of the mailpieces.

3. The method as claimed in claim 1, wherein evaluation of the measured results does not start until after a specified delay time after a change in speed measured by a sensor to a speed deviating from the nominal speed of the following transport stage only by a specified small value.

4. An arrangement for detecting overlapping flat mailpieces in a transport path for mailpieces that are transported vertically in succession, having:

at least two transport stages in succession in the transport path, wherein each transport stage has a nominal speed, and wherein the nominal speed of a following transport stage in a transport direction in each case is higher than the nominal speed of a transport stage preceding it, two sensors arranged on either side of the transport path for measuring a speed of the transported mailpieces by scanning said items in front of a following transport stage in each case for a maximum distance that is shorter than a shortest agreed mailpiece length, and a device for evaluating measured results if a sensor measures a speed that deviates from the nominal speed of the following transport stage only by a defined small value, such that an overlap is detected if simultaneously measured speeds of the two sensors are different and a smaller measured speed deviates from a greater speed by a specified value.

5. The arrangement as claimed in claim 4, wherein the sensors for measuring the speed of the mailpieces are embodied as locally fixed rollers or belts running on mailpiece surfaces, wherein rotational speeds of said rollers or belts serve as a measure for the speed of the mailpieces.

* * * * *